United States Patent [19]

Fiene

[11] Patent Number: 4,972,181

[45] Date of Patent: Nov. 20, 1990

[54] A. C. POWERED SMOKE DETECTOR WITH BACK-UP BATTERY SUPERVISION CIRCUIT

[75] Inventor: Dale E. Fiene, Addison, Ill.

[73] Assignee: Fyrnetics, Inc., Elgin, Ill.

[21] Appl. No.: 11,024

[22] Filed: Feb. 5, 1987

[51] Int. Cl.[5] ..... G08B 21/00

[52] U.S. Cl. ..... 340/636; 340/628; 340/516

[58] Field of Search ..... 340/636, 628, 629, 630, 340/516; 324/433, 427, 428; 320/21, 48

[56] References Cited

U.S. PATENT DOCUMENTS

| | | | |
|---|---|---|---|
| 3,997,831 | 12/1976 | Hopfner | 340/636 |
| 4,088,986 | 5/1978 | Boucher | 340/628 |
| 4,138,670 | 2/1979 | Schneider | 340/636 |
| 4,139,846 | 2/1979 | Conforti | 340/636 |
| 4,227,191 | 10/1980 | Raber | 340/636 |
| 4,251,811 | 2/1981 | Wittlinger | 340/636 |
| 4,266,219 | 5/1981 | Foster et al. | 340/636 |
| 4,333,093 | 6/1982 | Raber et al. | 340/636 |
| 4,388,615 | 7/1983 | Ford et al. | 340/636 |
| 4,419,658 | 12/1983 | Jarosz | 340/636 |
| 4,544,910 | 10/1985 | Hoberman | 320/48 |
| 4,563,628 | 1/1986 | Tietz et al. | 320/48 |

*Primary Examiner*—Joseph A. Orsino
*Assistant Examiner*—Jill D. Jackson
*Attorney, Agent, or Firm*—Robert E. Browne

[57] ABSTRACT

An A.C. powered smoke detector with supervision circuit for back-up battery. The circuit periodically and automatically, checks the power capacity of the back-up battery by momentarily disabling the D.C. power supply from applying D.C. voltage on a D.C. voltage bus while simultaneously applying a test load to the battery. If the test load voltage is too low, a low battery power capacity indication is provided. In one embodiment, the D.C. power supply is disabled by electrically disconnecting it from the battery. In another embodiment, a switch applies to effectively by pass the D.C. power supply and enable the application of the test load.

18 Claims, 1 Drawing Sheet

A. C. POWERED SMOKE DETECTOR WITH BACK-UP BATTERY SUPERVISION CIRCUIT

BACKGROUND OF THE INVENTION

This invention relates to an A.C. powered smoke detector with a back-up battery and, more particularly, to such a detector with a supervision circuit for monitoring the power capacity of the back-up battery without the need for first physically disconnecting the A.C. power from the detector.

There are basically three different types of commercially available smoke detectors categorized according to their electrical power supply. There are first those which are solely battery powered, secondly, those which are solely powered by conventional A.C. power provided by utility companies and, thirdly, those which are A.C. powered but have a back-up battery. The third type of detector is intended to be primarily powered by A.C. with the back-up battery only providing necessary power to operate the detection and alarm circuitry in the event of loss of A.C. power.

It is known to monitor the battery in the first and third types of detectors. In the third type of detector, this is done by operational testing of the battery by simulating a detection signal to the detection and alarm circuitry in response to actuation of a manually actuatable test switch. This procedure requires manual interaction which may not necessarily be forthcoming on a regular basis. It also causes the alarm to sound which depletes the battery to an undesirable extent for test purposes and can desensitize people to the alarm, if tested too often. In addition, failure of the alarm to sound during the test does not necessarily indicate that the battery is defective, for failure of the other parts of the circuitry can also cause such failure.

In the A.C. powered detectors with a back-up battery, the back-up battery voltage can only be compared to a minimum voltage if the A.C. power is first disconnected from the detection and comparison circuitry, and a test switch is manually actuated to perform an operational test as described above with respect to the battery operated detectors.

Accordingly, there has been a need for a battery back-up type of A.C. powered detector with a supervision circuit which monitors the power capacity of the battery, as opposed to only the voltage; and, which performs this monitoring fuction automatically on a periodic basis while the A.C. power remains physically connected to the detector.

SUMMARY OF THE INVENTION

It is therefore the principal object of the present invention to fulfill this need and provide an A.C. powered smoke detector with a back-up battery supervision circuit for testing the power capacity of the back-up battery without the necessity of sounding the alarm or physically disconnecting A.C. power from the detector during performance of the test.

This objective is achieved by providing the improved back-up battery supervision circuit of the present invention in conjunction with a smoke detector having a smoke detection circuit, an alarm actuatable by the detection circuit and a D.C. power supply. The D.C. power supply includes an A.C. input terminal for receiving A.C. power and a D.C.. output terminal on which it normally supplies output D.C. power to the detection circuit and to the alarm whenever it, in turn, is receiving A.C. input power. A back-up battery provides D.C power to the detection circuit and to the alarm in the event of loss of output D.C. power from the D.C. power supply.

In a preferred embodiment, the back-up battery supervision circuit comprises means for checking the power capacity of the back-up battery whenever a test load switch is actuated, means for actuating the test load switch, and means responsive to the power capacity being less than a preselected minimum to provide a low battery power indication. The power capacity checking means include, in addition to the test load switch, means for applying a preselected test load to the battery when the test load switch is actuated and means for comparing the voltage of the battery to a preselected minimum voltage corresponding to a preselected minimum power capacity when the test load switch is actuated and the battery is test loaded. The low battery power indication providing means is responsive to the voltage comparing means for providing the low battery power indication in response to the battery voltage being less than the preselected minimum voltage when the test load switch is actuated and the battery is test loaded. Preferably, an oscillator circuit is provided for periodically actuating the test load switch, although testing can also be acheived non-automaticallly in response to manual actuation, if desired.

When A.C. power is removed from the detection circuit, it is necessary that the power from the battery be immediately available, and thus both the battery and the output of the D.C. power supply are connected to a common D.C. voltage bus which is connected to the remaining circuitry. A diode interconnected between the back-up battery and the output of the D.C. power supply is provided to isolate the battery from the output of the D.C. power supply or D.C. voltage bus whenever D.C. power is being provided by the D.C. power supply. In order for the back-up battery power capacity to be tested, it is necessary to forward bias this isolation diode.

Advantageously, and unlike known A.C. powered detectors in which it was necessary to physically disconnect the A.C. power in order to perform the test, in the present invention the D.C. power supply is disabled automatically whenever there is a test of back-up battery power capacity.

In one embodiment, this objective is achieved by providing a supervisory circuit for the back-up battery as generally described above, with means for periodically disconnecting the D.C. power supply for a preselected time period, and means enabled during the period of disconnection of the D.C. power supply for checking the power capacity of the back-up battery. In one embodiment, the disconnecting means includes an electronic switch, such as a transistor, connected between the input of the D.C. power supply and the detection, comparison and test load circuits; and, means for periodically actuating the electronic switch to switch it to a relatively non-conductive state to disconnect the power supply output from the remainder of the circuitry and, in particular, from the voltage comparator and test load circuit.

The foregoing objects and advantageous features of the invention will be described in greater detail, and other advantageous features will be made apparent from a reading of the following detailed description which is given with reference to the several figures of the drawing.

DETAIL DESCRIPTION OF THE INVENTION

Figure 1A:
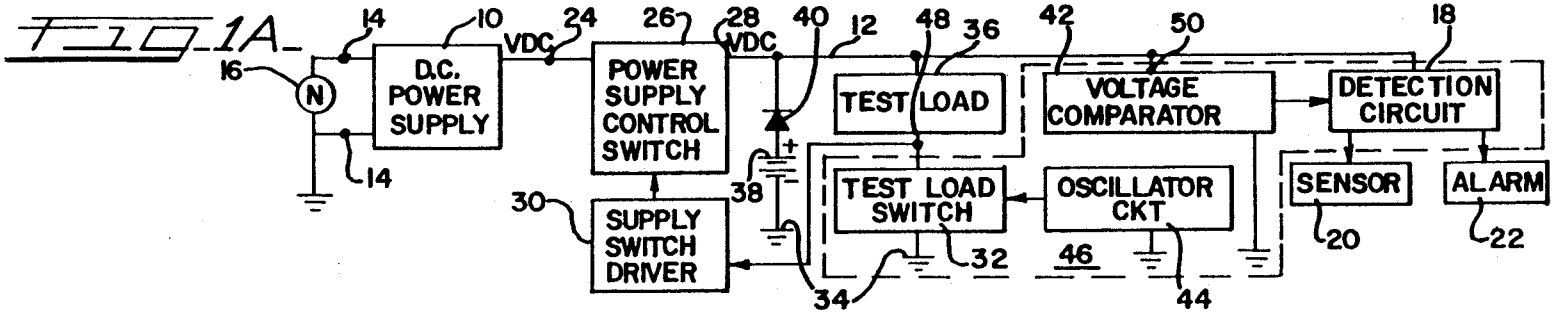
FIG. 1A is a funtional block diagram of a preferred embodiment of the A.C. powered detector with back-up battery supervision circuit of the present invention. In the circuit of FIG. 1A the D.C. power supply is disabled from providing output D.C. power by the inclusion of means for disconnecting it from the remainder of the circuitry.
Figure 1B:
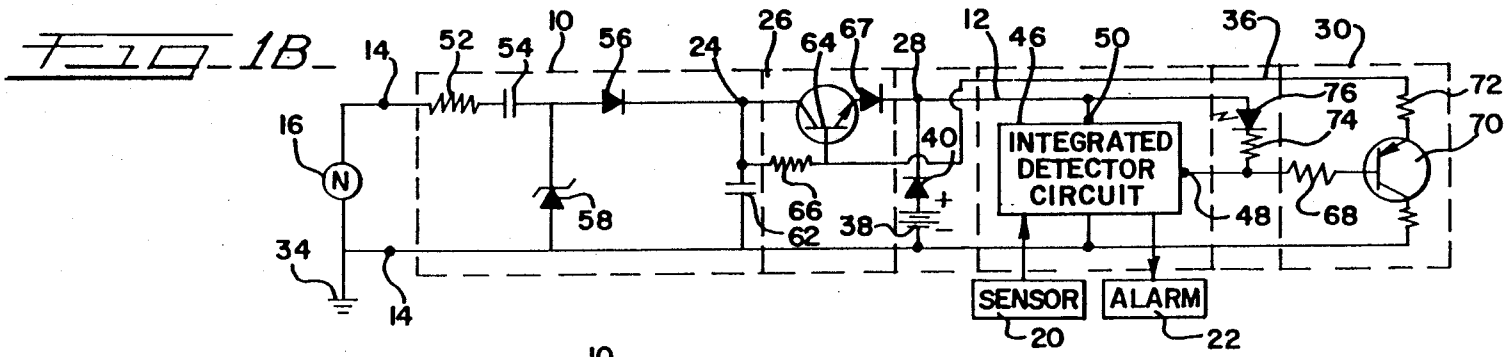
FIG. 1B is a partially functional block diagram and partially wiring schematic of the functional blocks of the detector of FIG. 1A.

Referring now to the drawings, particularly FIGS. 1A and 1B, the first embodiment of the A.C. powered detector with a back-up battery supervisory circuit of the present invention is seen to comprise a D.C. power supply 10 which provides a D.C. voltage VDC on a D.C. voltage bus 12 to the remaining circuitry. The D.C. power supply 10 has a pair of A.C. input terminals 14 which are hard wired, or releasibly connected, to an A.C. power source 16, such as the 115 V.A.C., 60 hertz power provided by utility companies. The circuitry of FIG. 1A includes a detection circuit 18 and a sensor 20, such as a photosensor or ionization chamber for detecting smoke. Sensor 20 provides detection signals to the detection circuit 18 whenever a sensed alarm condition is present to cause actuation of an alarm 22, such as a siren or other audible tone generator, by the detection circuit 18.

The D.C. power from the D.C. power supply 10 is provided on an output terminal 24 which, in turn, is coupled to the D.C. voltage bus 12 through a power supply control switch 26. The power supply control switch 26 is normally in a conductive state, and thus D.C. power is provided at its output 28 (connected with the D.C. voltage bus 12) except when a supply switch driver 30 is actuated. The supply switch driver 30 actuates the power supply control switch 26 in response to actuation of a test load switch 32 which is connected between ground reference potentional 34 and the positive D.C. voltage bus 12 through a test load 36.

Also, connected between the D.C. voltage bus 12, or the output 28 of power supply control switch 26 and ground refernce potential 34 is a back-up battery 38, such as a conventional nine volt dry cell. The back-up battery 38 is coupled through an isolation diode 40 which has its anode coupled to battery 38 and its cathode coupled to the voltage bus 12. With this polarity connection, the isolation diode 40 protects the battery 38 against reverse current surges from the power supply 10 and is reversed biased to prevent dissipation of power from battery 38 whenever the D.C. power supply 10 is providing the D.C. voltage VDC on the voltage bus 12.

Tn keeping with the present invention, two things occur when the test load switch 32 is actuated. First, a signal is applied to actuate supply switch driver 30 which, in turn, actuates power supply control switch 26 to disconnect the D.C. power supply 10 from the D.C. voltage bus 12. This causes diode 40 to become forwardly biased to enable the back-up battery 38 to provide power to the remaining circuitry, particularly the test load switch 32. In addition, the test load switch 32 connects the battery 38 and diode 40 in a circuit with test load 36 to load the battery 38 by a preselected amount, such as ten milliamperes.

Advantageously, with the test load 36 being applied to battery 38, the measurement of the voltage on voltage bus 12 is then a measurement of the power capacity of battery 38 which would not be achieved with simple measurement of its open circuit voltage. This power capacity indicating voltage is then compared by a voltage comparator 42 to a preselected minimum voltage which is indicative of a preselected low power capacity condition of battery 38. If the detected voltage from battery 38 is less than the preselected minimum voltage, then the voltage comparator 42 provides a signal to cause the detection circuit 18 to actuate alarm 22 in a mode indicative of a low battery condition, such as generation of a periodic chirping sound instead of a continuous tone.

Figure 2:
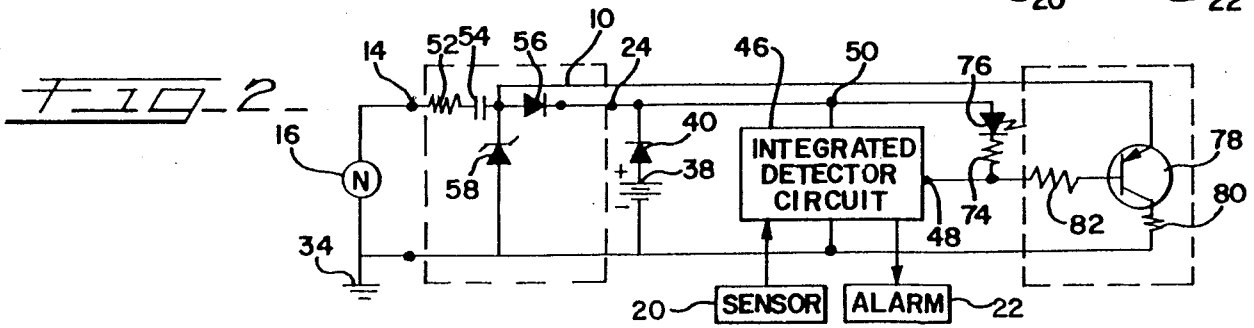
FIG. 2 is a partially functional block diagram and partially circuit schematic of another embodiment of the invention and in which the D.C. power supply is disabled by short circuiting its A.C. input through one switch which enables test loading of the battery through another switch.

While the test load switch 32 can be any type of switch, including a manually actuable switch, preferably it is automatically, periodically actuated by an oscillator circuit 44. The particular details of the voltage comparator 42, the test load switch 32, the oscillator circuit 44 and the detection circuit 18 form no part of the present invention. In fact, all of such circuits are commercially available in a single integrated detector circuit package such as a Motorola MC14468 integrated circuit package. Descriptions of the details of such a circuits are found in specification sheets and catalog sheets published by Motorola Corporation. Suitable detection circuits, sensors and alarms are also shown in U.S. Pat. Nos. 4,083,037 and 4,246,572 of Larsen which are assigned to the assignee of this invention. Accordingly, these circuit elements are hereinafter collectively shown as a single integrated detector circuit 46, as shown in FIGS. 1B, and 2. For instance, in FIG. 1B, the output of the test load switch 32 is at terminal 48, and the input of the voltage comparator 42 is connected at terminal 50 to D.C. voltage bus 12.

Referring now to FIG. 1B which illustrates a preferred embodiment of circuitry for the D.C. power supply 10, the power supply control switch 26, the supply switch driver 30 and the test load 36. The power supply 10 includes a surge resistor 52, a smoothing capacitor 54 and a rectifying diode 56 connected in series between an input terminal 14 and the output terminal 24. A zenor diode 58 is interconnected between ground reference potential 34 and the junction between capacitor 54 and rectifying diode 56 and with its cathode connected to the junction of capacitor 54 and its anode connected to ground reference. This Zenar diode 58 clips the rectified signal at output terminal 24 to a preseletected maximum level, such as 11 volts D.C., and capacitor 62 filters or smooths this D.C. output signal from the D.C. power supply 10.

This D.C. voltage from the D.C. power supply 10 appears at the D.C. voltage bus 12 so long as a transistor 64 is in a conductive state. A bias resistor 66 is provided between the collector and base of transistor 64, and the collector is connected to the output terminal 24 to normally bias the transistor 64 to a conductive state. Under these conditions, the voltage at output terminal 24 of power supply 10 appears at the output terminal 28 of power supply control switch 26. The diode 67 interconnected between the emitter of transistor 64 and output 28 is forward biased, and the voltage at output terminal 28 reverse biases the isolation diode 40 associated with the back-up battery 38. Diode 67 protects the emitter of transistor 64 against reverse bias from battery 38 during test.

Periodically, the oscillator circuit 44 of the integrated detector circuit 46 (FIG. 1A) actuates the test load switch 32 to apply a zero voltage state, or ground reference level, pulse to output terminal 48. This zero voltage state pulse is coupled through a limiting resistor 68 to apply base drive to PNP transistor 70 of supply switch driver 30. The collector of transistor 70 is connected to ground reference 34, while the emitter is connected through resistor 72 to the base of transistor 64. Accordingly, when transistor 70 is energized to conduct, it causes removal of base drive from transistor 64 otherwise being provided through bias resistor 66; accordingly, transistor 64 turns off. This action forward biases diode 40 to enable it to load battery 38 with a test load provided by resistor 74 interconnected therewith through D.C. voltage bus 12. The light emitting diode 76 is optional and may or may not be included in the circuit.

This test load condition occurs on the order of approximately once every forty seconds and has a relatively short duration on the order of approximately ten milliseconds. During each of these ten millisecond battery test periods, the voltage at the output terminal 28 of power supply switch 10 drops off in response to an approximately ten milliampere load on battery 38. If the voltage on the D.C. bus 12 drops below a preselected level established by voltage comparator 42 of the integrated detector circuit 46, the voltage comparator 42 actuates the detection circuit 18. The detection circuit 18 then momentarily actuates alarm 22 at a frequency on the order of approximately once per minute.

Referring now to FIG. 2, another embodiment of the supervision circuit is shown. In FIG. 2, the power supply contol switch 26 and supply switch driver 30 of FIGS. 1A and 1B have been eliminated, and instead, a PNP transistor 78 is utilized to provide a similar function. The collector of transistor 78 is coupled to ground reference 34 through a load resistor 80, and the emitter is coupled directly to the anode of diode 56 and thus through capacitor 54 and resistor 52 to the A.C. terminal 14. The base of transistor 78 is coupled through a limit resistor 82 output terminal 48 of integrated detector circuit 46.

Accordingly, whenever the signal on output terminal 48 of integrated detector circuit 46 momentarily switches to a logic zero state, transistor 78 is caused to turn on and saturate, thus preventing the D.C. power supply 10 from providing the D.C. voltage at its output terminal 24 whenever transistor switch 78 has been turned on. When transistor 78 conducts, it effectively bypasses the output terminal 24 of the D.C. power supply 10. Note that the emitter of transistor 78 is isolated from the back-up battery 38 by diode 56 of the D.C. power supply 10; that is, it does not directly load the back-up battery 38. Instead, in response to actuation of transistor switch 78, the voltage signal VDC provided by the D.C. power supply 10 is removed from junction 24. This action causes forward biasing of isolation diode 40 to enable the loading of battery 38 through load resistor 74 and through the test load switch 32 within integrated detector circuit 46.

While particular embodiments have been disclosed which are preferred embodiments, it should be appreciated that many variations may be made thereto without departing from the scope of the invention as defined in the appended claims. For instance, while all embodiments have shown the use of the alarm 22 used to indicate an alarm condition to also provide a low battery power indication, it should be appreciated that separate alarms and, in fact, separate oscillator circuits and voltage comparator circuits could be used for these purposes, if desired. In addition, while use of an integrated detector circuit, such as the Motorola MC14468 integrated circuit package, is preferred, it is not necessary that this particular circuit be used or even that all of the functional elements illustrated in FIG. 1A be integrated together in a single circuit. Also, while the circuit shown in the figures use a half wave rectifier for the D.C. power supply, a full wave bridge could also be used.

I claim:

1. In a smoke detector with a smoke detection circuit, an alarm actuatable by the detection circuit and a D.C. power supply with an A.C. input terminal for receiving A.C. power and a D.C. output terminal on which it normally supplies output D.C. power to the detection circuit and alarm whenever it, in turn, is receiving A.C. input power and a back-up battery to provide D.C. power to the detection circuit and the alarm in the event of loss of output D.C. power from the D.C. power supply, the improvement being a supervision circuit for the back-up battery, comprising:

(a) means for checking the power capacity of the back-up battery by loading the battery including:
  (i) a test load switch,
  (ii) means for applying a preselected test load to the battery when the test load switch is actuated, and
  (iii) means for comparing the voltage of the battery to a preselected minimum voltage corresponding to a preselected minimum power capacity when the test load switch is actuated and the battery is test loaded;
(b) means for actuating the test load switch;
(c) means for switchably disconnecting the D.C. power supply during battery test; and
(d) means responsive to said power checking means for providing a low battery power indication in response to the battery power capacity being less than said preselected power capacity.

2. The smoke detector of claim 1 in which said test load switch is an electronic switch, and the test load switch actuating means includes means for automatically and periodically actuating said test load switch for a preselected, relatively short duration during each of a plurality of successive test cycles.

3. The smoke detector of claim 2 in which the time between periods of actuation is in the order forty seconds.

4. The smoke detector of claim 1 or 2 in which said preselected duration of actuation is on the order of 10 milliseconds.

5. The smoke detector of claim 1 or 2 in which said means for electrically disconnecting the output of the D.C. power supply comprises an electronic switch.

6. The smoke detector of claim 5 in which said disconnecting means includes:

a power supply control switch interconnected between the D.C. power supply and the comparing means, and means for opening said power supply control switch in response to actuation of the test load switch.

7. The smoke detector of claim 1 including a diode connected between said battery and the voltage comparator for isolating the back-up battery from the output of the D.C. power supply.

8. The smoke detector of claim 7 in which actuation of the test load switch causes current to be drawn from the battery at a level on the order of ten milliamperes.

9. The smoke detector of claim 1 in which said low battery indicating means include means for actuating said alarm in a mode different from the mode in which it is actuated by said smoke detector in response to detection of smoke.

10. The smoke detector of claim 1 in which said smoke detection circuit, said voltage comparing means and said low battery indication means are combined in a single integrated circuit package together with an oscillator, and said switch actuating means includes means responsive to said oscillator for periodically actuating said test load switch.

11. In a smoke detector with a smoke detection circuit, an alarm actuatable by the detection circuit and a D.C. power supply with an A.C. input terminal for receiving A.C. power and a D.C. output terminal on which it normally supplies output D.C. power to the detection circuit and alarm whenever it, in turn, is receiving A.C. input power and a back-up battery to provide D.C. power to the detection circuit and the alarm in the event of loss of output D.C. power from the D.C. power supply, the improvement being a supervision circuit for the back-up battery, comprising:

means for periodically electrically switchably disconnecting the D.C. power supply for a preselected time period; and means enabled during said period of disablement of the D.C. power supply for checking the power capacity of the back-up battery by loading the battery.

12. The detection circuit of claim 11 in which said disconnecting means includes a power supply control switch connecting between the output of the D.C. power supply and the detection circuit, and means for periodically actuating said power supply control switch to a relatively non-conductive state to electrically disconnect the power supply from the detection circuit.

13. The detection circuit of claim 13 in which said battery power capacity checking means includes another switch enabled in response to the control switch being in a relatively non-conductive state to load said battery, and means for comparing the voltage of the back-up battery, when loaded, to a preselected minimum voltage.

14. The detection circuit of claim 13 in which said another switch is a diode connected between the battery and the D.C. power supply output with a polarity to isolate the battery from the D.C. power supply when the voltage output level of the D.C. power supply is forced below the battery voltage.

15. In a smoke detector with a smoke detection circuit, an alarm actuatable by the detection circuit and a D.C. power supply with an A.C. input terminal for receiving A.C. power and a D.C. output terminal on which it normally supplies output D.C. power to the detection circuit and alarm whenever it, in turn, is receiving A.C. input power and a back-up battery to provide D.C. power to the detection circuit and the alarm in the event of loss of output D.C. power from the D.C. power supply, the improvement being a supervision circuit for the back-up battery, comprising:

means including a switch connected for disabling said D.C. power supply from providing D.C. output power;

battery connecting means for momentarily electrically connecting the back-up battery through a test load when said D.C. power supply is disabled; and means for comparing the power capacity of said battery to a preselected minimum capacity when it is being electrically connected through said test load.

16. The smoke detector circuit of claim 15 in which said battery connecting means includes a test load switch for connecting the battery with the test load.

17. The smoke detector of claim 16 including means responsive to actuation of the test load switch to actuate the disabling means.

18. The smoke detector of claim 17 in which said battery connecting means includes the switch of said disabling means and means for connecting the D.C. output of the power supply through said test load when actuated.

* * * * *

US004972181C1

(12) EX PARTE REEXAMINATION CERTIFICATE (7587th)

United States Patent

Fiene

(10) Number: US 4,972,181 C1

(45) Certificate Issued: Jul. 6, 2010

(54) A. C. POWERED SMOKE DETECTOR WITH BACKUP BATTERY SUPERVISION CIRCUIT

(75) Inventor: Dale E. Fiene, Addison, IL (US)

(73) Assignee: Walter Kidde Portabale Equipment, Inc., Wilmington, DE (US)

Reexamination Request:
No. 90/008,905, Oct. 26, 2007

Reexamination Certificate for:

| | |
|---|---|
| Patent No.: | **4,972,181** |
| Issued: | **Nov. 20, 1990** |
| Appl. No.: | **07/011,024** |
| Filed: | **Feb. 5, 1987** |

(51) Int. Cl.

| | |
|---|---|
| ***G08B 29/18*** | (2006.01) |
| ***G08B 29/00*** | (2006.01) |

(52) U.S. Cl. ..... 340/636.16; 340/516; 340/628

(58) Field of Classification Search ..... None
See application file for complete search history.

(56) References Cited

U.S. PATENT DOCUMENTS

| | | | |
|---|---|---|---|
| 4,138,670 | A | 2/1979 | Schneider et al. |
| 4,316,133 | A | 2/1982 | Locke, Jr. |
| 4,383,251 | A | 5/1983 | Perelli et al. |
| 4,388,615 | A | 6/1983 | Ford et al. |
| 4,544,910 | A | 10/1985 | Hoberman |
| 4,595,914 | A | 6/1986 | Siegel |

OTHER PUBLICATIONS

Motorola Inc. Motorola CMOS/NMOS Special Functions Data, Series A, 1984 pp. 8–8 to 8–17.

Motorola Inc, MC 14466, 1980.

Motorola Inc. MC14461 MC14462, 1977, pp. MO10444–MO10453.

Millman, J., et al., "Second edition Microelectronics," 1987, pp. 79–114.

Horowitz, P, et al., "The Art of Electronics," Second Edition, 1989.

Underwriters Laboratories Inc., "UL 217 Standard for Safety, Single and Multiple Station Smoke Detectors," UL 217, Third Edition, Oct. 7, 1985, pp. 12–13.

Jay, Frank, "IEEE Standard Dirctionary of Electical and Electronics Term," Third Edition, Aug. 10, 1984, pp. 262–263.

*Primary Examiner*—Woo H. Choi

(57) ABSTRACT

An A.C. powered smoke detector with supervision circuit for back-up battery. The circuit periodically and automatically, checks the power capacity of the back-up battery by momentarily disabling the D.C. power supply from applying D.C. voltage on a D.C. voltage bus while simultaneously applying a test load to the battery. If the test load voltage is too low, a low battery power capacity indication is provided. In one embodiment, the D.C. power supply is disabled by electrically disconnecting it from the battery. In another embodiment, a switch applies to effectively by pass the D.C. power supply and enable the application of the test load.

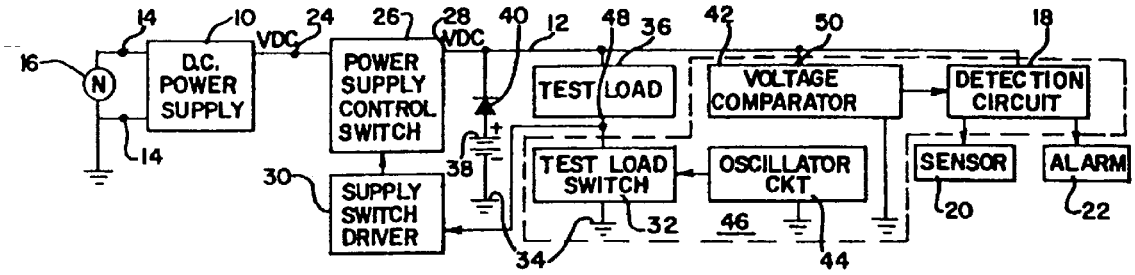

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-18 are cancelled.

* * * * *